US011874021B2

(12) United States Patent
He et al.

(10) Patent No.: US 11,874,021 B2
(45) Date of Patent: Jan. 16, 2024

(54) FABRICATED AIR CONDITIONER WALL AND OPERATION METHOD THEREOF

(71) Applicant: ZHEJIANG UNIVERSITY, Hangzhou (CN)

(72) Inventors: Guoqing He, Hangzhou (CN); Wenjie Zhao, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 249 days.

(21) Appl. No.: 16/772,181

(22) PCT Filed: Sep. 3, 2019

(86) PCT No.: PCT/CN2019/104210
§ 371 (c)(1),
(2) Date: Jun. 12, 2020

(87) PCT Pub. No.: WO2020/103522
PCT Pub. Date: May 28, 2020

(65) Prior Publication Data

US 2021/0364174 A1 Nov. 25, 2021

(30) Foreign Application Priority Data

Nov. 23, 2018 (CN) ..... 201811409507.7

(51) Int. Cl.
*F24F 5/00* (2006.01)
*F24F 13/22* (2006.01)
(Continued)

(52) U.S. Cl.
CPC ..... *F24F 5/0046* (2013.01); *E04C 2/288* (2013.01); *E04C 2/46* (2013.01); *E04C 2/525* (2013.01);
(Continued)

(58) Field of Classification Search
CPC . E04C 2/525; E04C 2/46; E04C 2/288; E04C 5/0046; F24F 13/222; F24F 1/029; F24F 1/0314; F24F 1/027; F25B 41/20
See application file for complete search history.

(56) References Cited

FOREIGN PATENT DOCUMENTS

CN 2937957 Y * 8/2007
CN 101545659 A 9/2009
(Continued)

OTHER PUBLICATIONS

International Search Report (PCT/CN2019/104210); dated Dec. 4, 2019.

*Primary Examiner* — Frantz F Jules
*Assistant Examiner* — Martha Tadesse
(74) *Attorney, Agent, or Firm* — W&G Law Group

(57) ABSTRACT

The present disclosure discloses a fabricated air conditioner wall and an operation method thereof, and the fabricated air conditioner wall included a precast wall and a heat pump system embedded in the precast wall. The components of the fabricated air conditioner wall are mass-produced and assembled in factories. The fabricated air conditioner wall mainly includes an indoor heat exchanger, a throttle valve, a condensate water tank, a four-way valve, a wall-buried pipe, a compressor, and an outdoor heat exchanger. In a cooling mode, condensate water is collected in the condensate water tank to cool the refrigerant. In winter, when the precast wall is illuminated by sunlight, a temperature of an outer wall is often higher than a temperature of outdoor air, and this solar energy can be reasonably utilized by the wall-buried pipe, thereby improving the heating effect of the air conditioner itself.

9 Claims, 4 Drawing Sheets

(51) Int. Cl.
*E04C 2/288* (2006.01)
*E04B 2/00* (2006.01)
*E04C 2/52* (2006.01)

(52) U.S. Cl.
CPC .... *F24F 13/222* (2013.01); *F24F 2005/0064* (2013.01); *F24F 2221/17* (2013.01)

(56) References Cited

FOREIGN PATENT DOCUMENTS

| | | | | |
|---|---|---|---|---|
| CN | 101736818 | A | | 6/2010 |
| CN | 102313344 | A | | 1/2012 |
| CN | 103233532 | A | * | 8/2013 |
| CN | 103233532 | A | | 8/2013 |
| CN | 109610683 | A | | 4/2019 |
| CN | 209230065 | U | | 8/2019 |
| JP | H0432633 | A | * | 2/1992 |
| JP | H10232030 | A | | 9/1998 |

* cited by examiner

FABRICATED AIR CONDITIONER WALL AND OPERATION METHOD THEREOF

CROSS-REFERENCE TO RELATED APPLICATIONS

This application is a national stage of International Application No PCT/CN2019/104210, filed on Sep. 3, 2019, which claims priority to Chinese Patent Application No. 201811409507.7, filed on Nov. 23, 2018. Both of the aforementioned applications are hereby incorporated by reference in their entireties.

TECHNICAL FIELD

The present disclosure belongs to the technical field of construction equipment, and relates to a construction of an integrated functional precast wall that combines an air conditioner equipment and a precast wall, and particularly relates to a fabricated air conditioner wall and an operation method thereof.

BACKGROUND

The air conditioner has become an important electrical equipment for regulating the indoor environment in the modern society. With economic development and social progress, merely controlling the indoor temperature and humidity does not meet people's demands anymore, and improving air quality has become another demand. More and more houses or offices are equipped with air conditioners and fresh-air fans.

For a traditional separate-type air conditioner, it is flexible in arrangement and installation and is also flexible in use and control, and thus it is widely used in office buildings and commercial and residential buildings. However, such air conditioners are not aesthetic, have low efficiencies, and provide no fresh air. For a centralized-type air conditioner, although an indoor decoration is improved and fresh air can be easily achieved, a system layout thereof is complicated and an installation period thereof is long, moreover, controlling thereof is not as convenient as that of the separate-type air conditioner.

In addition, in most cases, in summer, the temperature of condensate water of the air conditioner is relatively low, and simply discharging it outdoors is not good for the environment and causes energy waste; in winter, an air-source heat pump has a lower heating capacity in low temperature weather, and a temperature of an outer wall exposed to sunlight is often higher than a temperature of the outdoor air. In this case, reasonably utilizing such solar energy is conducive to improving heating capacity of the system.

The buildings are developed in a fabricated mode. The fabricated building has a short construction period, and an entire construction thereof is prefabricated in a factory so that installation quality can be ensured. Therefore, a combination of the air conditioner equipment and the fabricated precast wall can not only reduce the building installation cost and energy consumption, but also ensure the installation quality and improve energy saving efficiency of the equipment.

SUMMARY

The purpose of the present disclosure is to solve the problems existing in the prior art and provide a fabricated air conditioner wall.

The specific technical solutions of the present disclosure are as follows.

A fabricated air conditioner wall includes a precast wall and a heat pump system located in the precast wall. The precast wall is provided with an inner thermal insulation layer and an outer thermal insulation layer. The inner thermal insulation layer is located in the precast wall and on a side close to an inner wall surface of the precast wall and is configured to reduce heat exchange between the precast wall and an indoor environment, and the outer thermal insulation layer is located in the precast wall and on a side close to an outer wall surface of the precast wall. The heat pump system includes a refrigerant circulation system and an air heat exchange duct. The refrigerant circulation system includes an indoor heat exchanger, a throttle valve, a condensate water tank, a four-way valve, a compressor, and an outdoor heat exchanger. The compressor includes an inlet and an outlet respectively connected to a first flow channel port and a second flow channel port of the four-way valve, a third flow channel port of the four-way valve is sequentially connected to the outdoor heat exchanger, the throttle valve and the indoor heat exchanger, the indoor heat exchanger is further connected to a fourth flow channel port of the four-way valve to form a refrigerant circuit, the condensate water tank is provided to be configured to receive condensate water discharged from the indoor heat exchanger and is provided with a water outlet communicating with an outdoor environment, and a refrigerant pipeline connecting the outdoor heat exchanger with the throttle valve passes through the condensate water tank to utilize the cooling energy of condensate water stored in the condensate water tank. The air heat exchange duct includes a return air duct and an outdoor heat exchanger air duct. The air heat exchange duct includes a return air duct and an outdoor heat exchanger air duct, the return air duct is located between the inner thermal insulation layer and the inner wall surface, and the return air duct is configured to perform heat exchange between the indoor air and indoor heat exchanger. The return air duct includes an air inlet and an air outlet that are located at the inner wall surface and communicate with the indoor environment. The indoor heat exchanger is located in the return air duct, and a first fan is provided in the return air duct configured to increase air flowing in the outdoor heat exchanger air duct to increase a heat exchange efficiency. The outdoor heat exchanger air duct is located between the outer thermal insulation layer and the outer wall surface. The outdoor heat exchanger air duct is configured to achieve heat exchange between the outdoor air and the outdoor heat exchanger. The outdoor heat exchanger air duct includes and an air inlet and an air outlet that are located at the outer wall surface and communicate with the outdoor environment. The outdoor heat exchanger is located in the outdoor heat exchanger air duct, and the outdoor heat exchanger air duct is provided with a third fan therein to increase air flow of the outdoor heat exchanger air duct, thereby increasing the heat exchange efficiency.

The fabricated air conditioner wall is precast as a whole, and components thereof can be simply assembled during installation.

Preferably, the first fan is located upwind of the indoor heat exchanger in the return air duct, and the third fan is located upwind of the outdoor heat exchanger in the outdoor heat exchanger air duct.

Preferably, the refrigerant circulation system further includes a wall-buried pipe, a first three-way valve, a first three-way pipe, a second three-way valve and a second three-way pipe, the wall-buried pipe is located in the precast wall and is located between the outer thermal insulation layer and the outer wall surface. Connection relations thereof are as follows. The first three-way valve and the first three-way pipe are provided in a refrigerant pipeline between the third flow channel port of the four-way valve and the outdoor heat exchanger; the third flow channel port of the four-way valve is connected to a first flow channel port of the first three-way valve, a second flow channel port of the first three-way valve is connected to a first flow channel port of the first three-way pipe, and a second flow channel port of the first three-way pipe is connected to an end of the outdoor heat exchanger; a third flow channel port of the first three-way valve is connected to an end of the wall-buried pipe, and another end of the wall-buried pipe is connected to a third flow channel port of the second three-way valve; a first flow channel port of the second three-way valve is connected to a third flow channel port of the first three-way pipe; a first flow channel port of the second three-way pipe is connected to another end of the outdoor heat exchanger; a second flow channel port of the second three-way pipe is connected to a second flow channel port of the second three-way valve; a third flow channel port of the second three-way pipe is connected to the throttle valve; the refrigerant pipeline between the third flow channel port of the second three-way pipe and the throttle valve passes through the condensate water tank.

A main purpose of providing the wall-buried pipe is to utilize solar energy in winter to increase the temperature of the refrigerant before entering the compressor and increase the COP. Secondly, in summer, the cooling energy stored in the wall can be utilized to reduce the temperature of the refrigerant before throttling and increase the COP. The above-mentioned connection manner is only a specific implementation manner for achieving this purpose.

Preferably, the fabricated air conditioner wall further includes a fresh air duct, the fresh air duct includes a main body located between the inner thermal insulation layer and the outer thermal insulation layer, an air inlet located at the outer wall surface, a side surface of a window or a top surface of a window and communicating with outdoor air, and an air outlet connected to the return air duct to serve as another air inlet of the return air duct, the air outlet of the fresh air duct is provided with a fresh air valve to control opening or closing of the fresh air duct, and the fresh air valve is controlled by a motor and is provided with a second fan therein. A main purpose of providing the fresh air passage is to introduce outdoor fresh air based on demands.

Further preferably, the air inlet of the fresh air duct is facing down.

Further preferably, the second fan is located upwind of the fresh air valve in the fresh air duct.

Preferably, the condensate water in the condensate water tank is discharged to the outer wall surface.

Preferably, the fresh air valve is made of a thermal insulation and sound insulation material. Further preferably, the motor and a carbon dioxide sensor are both connected to a control device, and the fresh air valve can be controlled to be switched on and off based on concentration of indoor carbon dioxide.

Preferably, primary-efficiency filters are respectively provided at the air outlet and the air inlet of the return air duct, the air outlet and the air inlet of the outdoor heat exchanger air duct, and the air inlet of the fresh air duct, and high-efficiency filters are respectively provided at the air outlet of the return air duct and the air outlet of the fresh air duct. Further preferably, the high-efficiency filter located at the outlet of the return air duct is located between the primary-efficiency filter and the indoor heat exchanger, and the high-efficiency filter located at the outlet of the fresh air duct is located between the fresh air valve and the second fan, so as to prevent ash from entering any air duct and purify the indoor air and air that enters from outside the room.

Preferably, the throttle valve, the condensate water tank, the four-way valve, the compressor and the outdoor heat exchanger are all disposed in an integrated outdoor unit, the outdoor unit is provided with an air inlet and an air outlet, so that the outdoor heat exchanger air duct passes through the outdoor unit. When manufacturing, various components have already been integrated in the outdoor unit, thereby further simplifying an installation process of the fabricated air conditioner wall.

Preferably, the outdoor unit is located in a preset embedded groove outside the precast wall, and a wall surface of the preset embedded groove is provided with a thermal insulation material thereon, the thermal insulation material insulates heat generated by the outdoor unit or prevent heat loss of the prefabricated wall.

Preferably, an access opening is respectively provided at each of the inner wall surface of the precast wall and the outer wall surface of the precast wall, a cover is provided on the access opening, and the access opening allows the primary-efficiency filter and the high-efficiency filter to pass through. The access opening is designed to facilitate later maintenance and also facilitate filter replacement.

Preferably, the condensate water tank is made of a plastic material.

Compared with a metal material, a plastic material has a lower thermal conductivity, which can prevent dissipation of the cooling energy of the condenser water.

Preferably, the return air duct is located between the inner thermal insulation layer and the inner wall surface, so as to minimize heat exchange.

The present disclosure further provides an operation method of the fabricated air conditioner wall, including a cooling mode and a heating mode.

1) When the heat pump system is in the cooling mode, the refrigerant circuit is as follows: the refrigerant is compressed by the compressor, and a refrigerant circuit after the compression of the compressor is cooled by the wall-buried pipe; if a temperature of the refrigerant is lower than an outdoor temperature after the refrigerant is cooled by the wall-buried pipe, the refrigerant circuit bypasses the outdoor heat exchanger; if the temperature of the refrigerant is higher than the outdoor temperature after the refrigerant is cooled by the wall-buried pipe, the refrigerant circuit is re-cooled by passing through the outdoor heat exchanger; and after being cooled, the refrigerant is further cooled by passing through the condensate water tank, then enters the indoor heat exchanger through the throttle valve for expanding and absorbing heat, and finally returns to the compressor.

2) When the heat pump system is in the heating mode, the refrigerant circuit is as follows: after being compressed by the compressor, the refrigerant enters the indoor heat exchanger for releasing heat and then passes through the throttle valve for expanding and cooling; if a temperature of the precast wall is lower than the outdoor temperature, the refrigerant after passing through the throttle valve absorbs heat only through the outdoor heat exchanger; if the temperature of the precast wall is higher than the outdoor temperature, the refrigerant after passing through the throttle valve absorbs heat again through the outdoor heat exchanger and the wall-buried pipe; and the refrigerant returns to the compressor after absorbing heat.

Compared with the prior art, the present disclosure has the following beneficial effects.

In this fabricated air conditioner wall, the heat pump system is directly integrated inside the precast wall, so that evaporator condensate water can be collected for recovery of the cooling energy. The refrigerant circuit of the heat pump system passes through the condensate water tank. In summer, the refrigerant can be sufficiently cooled by condensate water having a lower temperature to improve a cooling effect of the air conditioner and improve an energy utilization rate thereof. In addition, a wall-buried pipe can be provided in the precast wall. In winter, when the precast wall is illuminated by sunlight, a temperature of an outer wall surface is often higher than a temperature of outdoor air, and this solar energy can be reasonably utilized by the wall-buried pipe, thereby improving the heating effect of the air conditioner itself. In addition, the fabricated air conditioner wall can reduce a construction period, and each component thereof can be mass-produced in the factory, thereby ensuring installation quality thereof. The integration of the air conditioner equipment with the fabricated precast wall can reduce building installation costs and energy consumption.

Figure 1:
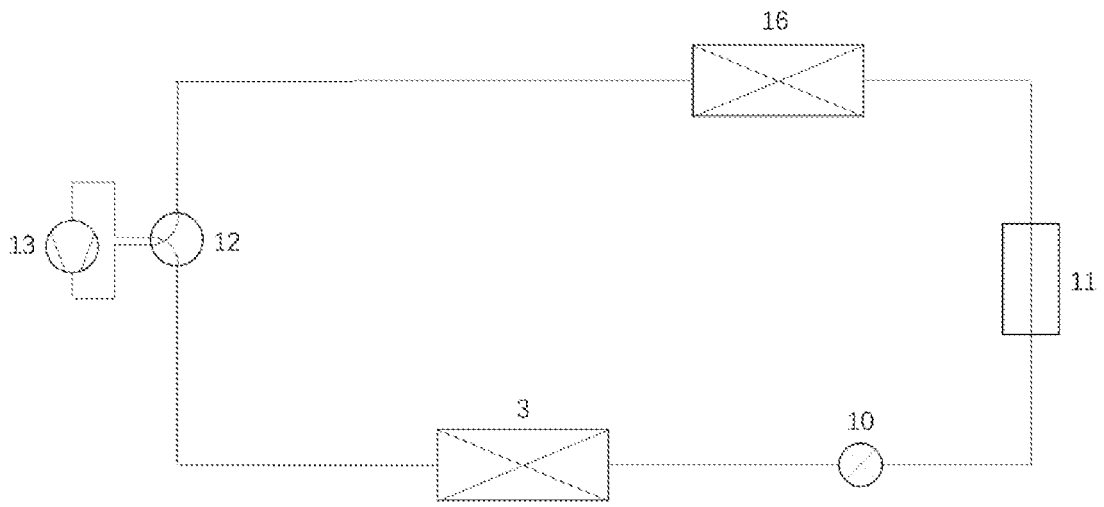
FIG. 1 is a schematic diagram of a refrigerant circuit according to Embodiment 1.

1—first primary-efficiency filter;
2—first high-efficiency filter;
3—heat exchanger;
4—first fan;
5—second primary-efficiency filter;
6—fresh air valve;
7—motor;
8—second high-efficiency filter;
9—second fan;
10—throttle valve;
11—condensate water tank;
12—four-way valve;
13—compressor;
14—third fan;
15—first three-way pipe;
16—outdoor heat exchanger;
17—first three-way valve;
18—second three-way pipe;
19—third primary-efficiency filter;
20—second three-way valve;
21—wall-buried pipe;
22—fourth primary-efficiency filter;
23—inner thermal insulation layer; and
24—thermal insulation layer.

DESCRIPTION OF EMBODIMENTS

The present disclosure will be further described in details in the following with reference to the accompanying drawings and specific embodiments.

Embodiment 1 is a simple implementation of the present disclosure, which provides a fabricated air conditioner wall including a precast wall and a heat pump system. The heat pump system is located in the precast wall. Each component of the fabricated air conditioner wall has been uniformly mass-produced in a factory, and the components only need to be assembled on site. In addition, such a fabricated air conditioner wall can reduce a construction period. Moreover, all components of an entire precast wall can be mass-produced in the factory, which can ensure installation quality thereof. Combination of the air conditioner equipment and the fabricated precast wall can also reduce building installation costs and energy consumption.

The precast wall is provided with an inner thermal insulation layer 23 and an outer thermal insulation layer 24. The inner thermal insulation layer 23 is located in the precast wall and at a side close to an inner wall surface and is configured to reduce heat exchange between the precast wall and the indoor environment. The outer thermal insulation layer 24 is located in the precast wall and at a side close to an outer wall surface. The double thermal insulation layer can also reduce heat exchange between the indoor environment and the outdoor environment under natural conditions, thereby preventing indoor overheating in summer or indoor overcooling in winter.

The heat pump system includes a refrigerant circulation system and an air heat exchange duct.

The refrigerant circulation system includes an indoor heat exchanger 3, a throttle valve 10, a condensate water tank 11, a four-way valve 12, a compressor 13, and an outdoor heat exchanger 16.

FIG. 1 illustrates a refrigerant circuit of a device in Embodiment 1. A circulation direction of the refrigerant is changed by changing the four-way valve 12, so that cooling and heating functions can be switched therebetween.

Figure 5:
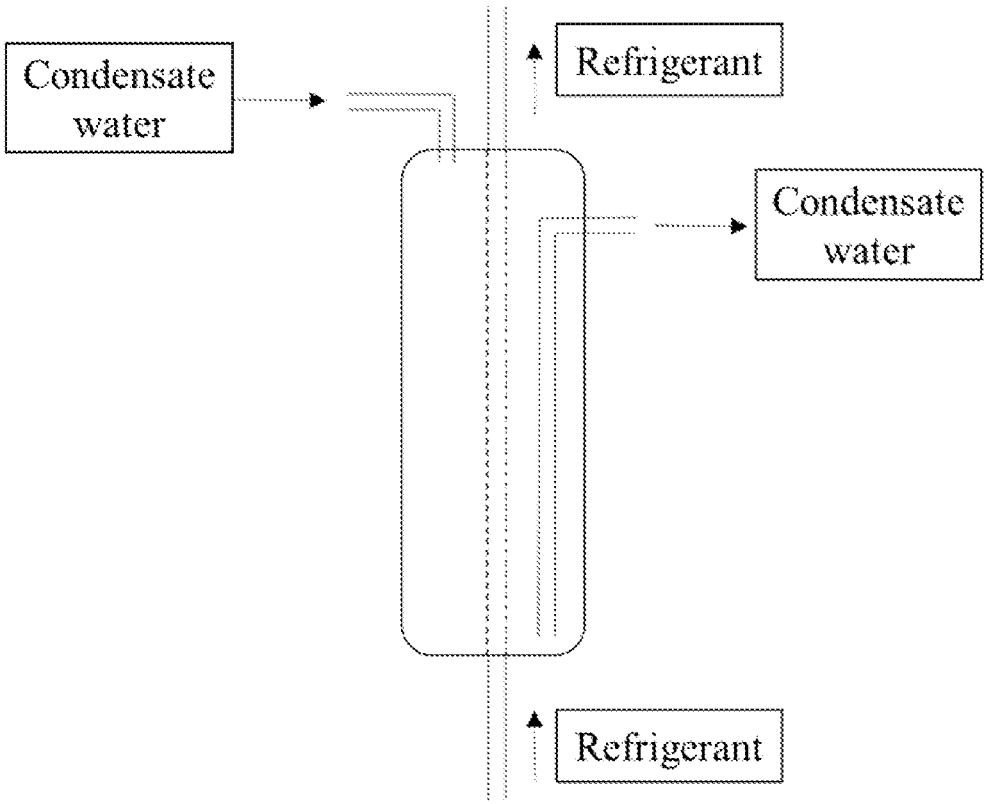
FIG. 5 is a schematic diagram of a structure of a condensate water tank according to Embodiment 2.

Specific connection relations thereof are as follows. The compressor 13 includes an inlet and an outlet that are respectively connected to a first flow channel port and a second flow channel port of the four-way valve 12. A third flow channel port of the four-way valve 12 is sequentially connected to the outdoor heat exchanger 16, the throttle valve 10, and the indoor heat exchanger 3. The indoor heat exchanger 3 is connected to a fourth flow channel port of the four-way valve 12. In this way, the refrigerant circuit is formed. In addition, the condensate water tank 11 is configured to receive condensate water discharged from the indoor heat exchanger 3, and a water outlet is provided on an upper portion of the condensate water tank 11 and communicates with the outdoor environment. As shown in FIG. 5, a refrigerant pipeline connecting the outdoor heat exchanger 16 with the throttle valve 10 passes through the condenser water tank 11 to utilize cooling energy of the condenser water in the condenser water tank. An interface thereof is waterproof and sealed, so as to prevent condensate from entering the condensate water tank 11 or prevent the condensate water in the condensate water tank 11 from flowing outside through the interface. Of course, it is also possible that two different paths are provided, and the condensate water tank is not passed through in winter. In the present embodiment, the condensate water tank 11 is made of a plastic material, or other material having good thermal insulation effect. Compared with a metal material, the plastic material has a lower heat conductivity, which can prevent dissipation of the cooling energy of the condenser water.

However, it should be noted that there are various pipeline connection manners, and the components thereof can be replaced according to actual conditions. For example, one four-way valve can be replaced by multiple two-way valves, etc., belonging to equivalent replacement of the present disclosure.

The air heat exchange duct is used for heat exchange between the heat pump system and indoor air or outdoor air and include a return air duct and an outdoor heat exchanger air duct. The return air duct is located between the inner thermal insulation layer 23 and the inner wall surface. The return air duct is used for heat exchange between the indoor air and the indoor heat exchanger 3. The return air duct includes an air inlet and an air outlet that are located at the inner wall surface and communicate with the indoor environment. The indoor heat exchanger 3 is located in the return air duct, and a first fan 4 is provided in the return air duct to increase an air flow in the return air duct, thereby increasing the heat exchange efficiency. The outdoor heat exchanger air duct is used for heat exchange between the outdoor air and the outdoor heat exchanger 16. The outdoor heat exchanger air duct includes an air inlet and an air outlet that are located at the outer wall surface and communicate with the outdoor environment. The outdoor heat exchanger 16 is located in the outdoor heat exchanger air duct, and a third fan 14 is provided in the outdoor heat exchanger air duct to increase an air flow in the outdoor heat exchanger air duct, thereby increasing the heat exchange efficiency. The first fan 4 is located upwind of the indoor heat exchanger in the return air duct. The third fan 14 is located upwind of the outdoor heat exchanger in the outdoor heat exchanger air duct.

Embodiment 2 of the present disclosure is a further improvement of the Embodiment 1. In Embodiment 2, a fabricated air conditioner wall is further provided with a wall-buried pipe 21. The wall-buried pipe 21 is located in the precast wall and is located between the outer thermal insulation layer 24 and the outer wall surface. The wall-buried pipe 21 can be a heat exchange pipe to recycle heat in the wall. In the present embodiment, the fabricated air conditioner wall can automatically select a corresponding refrigerant circuit according to a temperature of the precast wall and a heat exchange effect of the wall-buried pipe 21, so as to save energy more and increase the operation efficiency. After the wall-buried pipe 21 is provided, in winter, when the precast wall is illuminated by sunlight, a temperature of the outer wall surface is often much higher than a temperature of the outdoor air, in this case, this solar energy can be reasonably utilized through the wall-buried pipe, thereby improving the heating effect of the air conditioner; in summer, the cooling energy stored in the wall can be selectively utilized to reduce a temperature of the refrigerant before throttling and increase COP. In addition, in summer, the refrigerant can use the condensate water having lower temperature to fully cool down, thereby improving a cooling effect of the air conditioner and improving an energy utilization rate. Besides, a last condensate water outlet of the condensate water tank 11 is finally provided on the outer wall surface, and condensate water flows to the wall surface outside the wall-buried pipe can evaporate to reduce temperature of the outer wall, thereby increasing a heat exchange rate between the outer wall and the air. There are various design solutions of the refrigerant circuit that can achieve the above functions. For example, in Embodiment 2, one three-way valve can be replaced by two two-way valves. Therefore, it is impossible to list all design solutions that can achieve the functions. Thus, in the present disclosure, only a specific implementation manner will be described in details, but it should be noted that all solutions that can achieve the same functions through ordinary substitution belong to a protection scope of the present disclosure.

Figure 2:
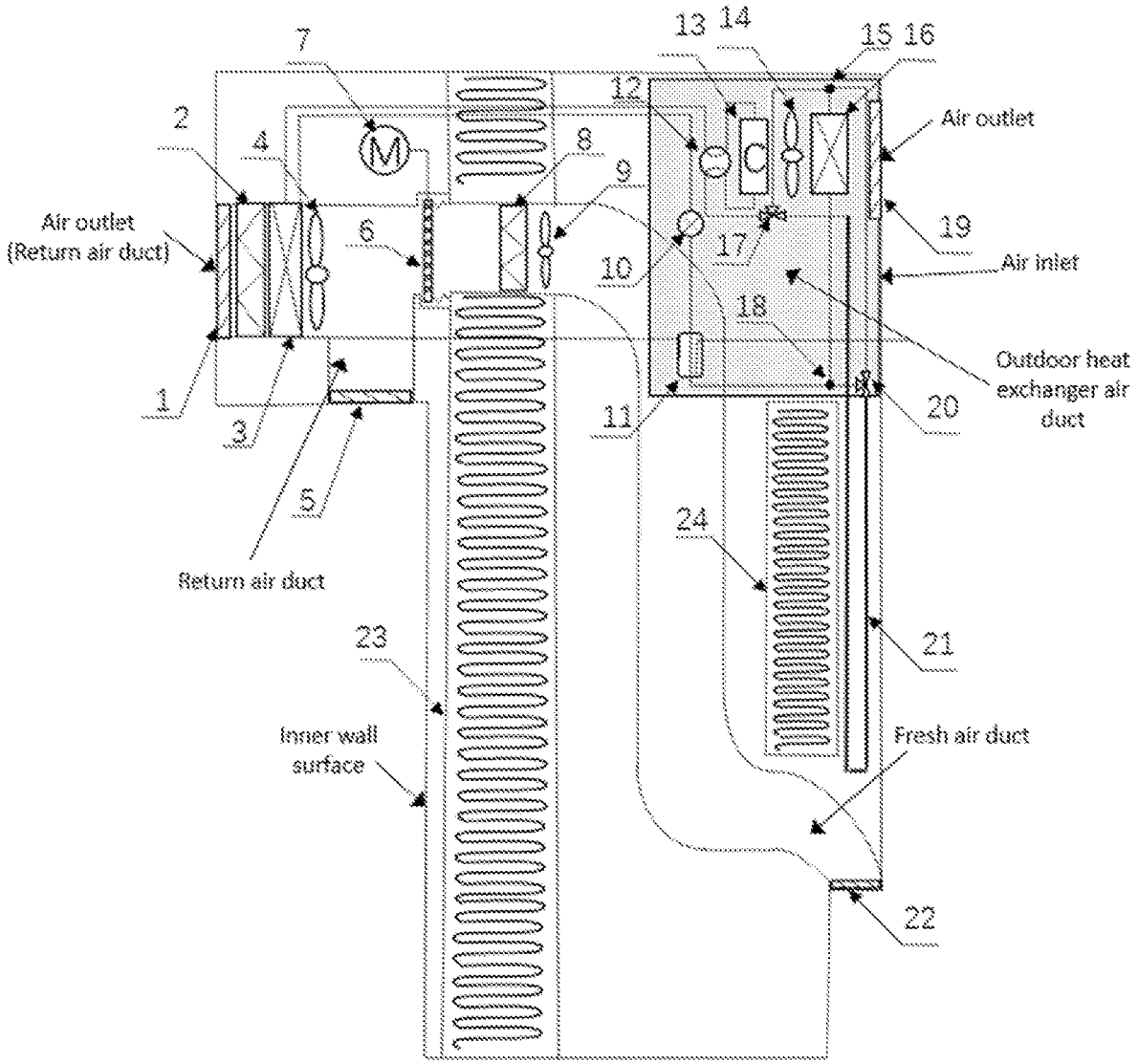
FIG. 2 is a schematic diagram of a structure of a fabricated air conditioner wall according to Embodiment 2.

FIG. 2 illustrates a specific connection manner of Embodiment 2. Connection relations between the indoor heat exchanger 3, the throttle valve 10, the condensate water tank 11, the four-way valve 12, the compressor 13, and the outdoor heat exchanger 16 is similar to the connection relations in Embodiment 1, and thus will not be repeated herein. Here, a connection of the wall-buried pipe 21, a fresh air duct, and a changing method of the refrigerator circuit will be mainly described in details.

In Embodiment 2, the refrigerant circulation system further includes a first three-way valve 17, a first three-way pipe 15, a second three-way valve 20, and a second three-way pipe 18. Specific connection therebetween are as follows. The first three-way valve 17 and the first three-way pipe 15 are provided in a refrigerant pipeline between the third flow channel port of the four-way valve 12 and the outdoor heat exchanger 16. The third flow channel port of the four-way valve 12 is first connected to a first flow channel port of the first three-way valve 17, a second flow channel port of the first three-way valve 17 is connected to a first flow channel port of the first three-way pipe 15, and a second flow channel port of the first three-way pipe 15 is connected to an end of the outdoor heat exchanger 16. The third flow channel port of the first three-way valve 17 is further connected to an end of the wall-buried pipe 21, another end of the wall-buried pipe 21 is connected to a third flow channel port of the second three-way valve 20. A first flow channel port of the second three-way valve 20 is connected to a third flow channel port of the first three-way pipe 15. A first flow channel port of the second three-way pipe 18 is connected to another end of the outdoor heat exchanger 16, a second flow channel port of the second three-way pipe 18 is connected to a second flow channel port of the second three-way valve 20, and a third flow channel port of the second three-way pipe 18 is connected to the throttle valve 10. The refrigerant pipeline between the third flow channel port of the second three-way pipe 18 and the throttle valve 10 passes through the condensate water tank 11.

Figure 6:
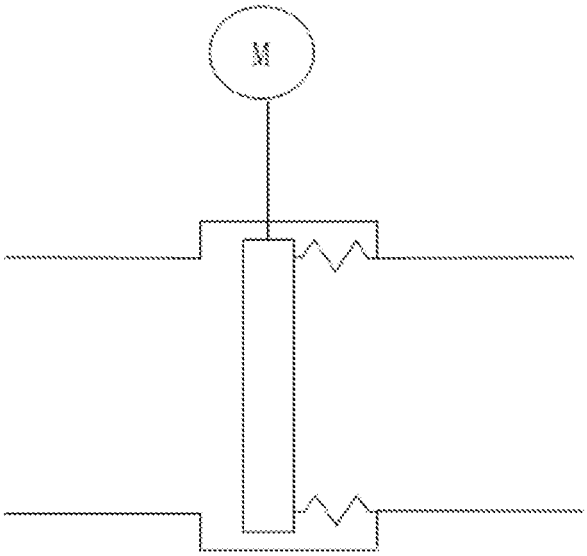
FIG. 6 is a schematic diagram of an electrically operated fresh air valve according to Embodiment 2.

In addition, a fresh air duct is further provided in Embodiment 2, which is mainly used to increase circulation of the indoor air to improve a quality of indoor air. A main body of the fresh air duct is located between inner thermal insulation layer 23 and the outer thermal insulation layer 24. The outer thermal insulation layer 24 is used to reduce heat exchange between the fresh air duct and the wall-buried pipe 21. The fresh air duct includes an air inlet that is provided on the outer wall surface and communicates with the outdoor air, and the air inlet of the fresh air duct is facing downwards to reduce rainwater backfill. In addition, the air inlet of the fresh air duct can also be provided at a side surface of a window or a top surface of a window, and a direction towards which the air inlet is facing can also be changed according to requirements. An air outlet of the fresh air duct is connected to the return air duct to serve as another air inlet of the return air duct and is provided with a fresh air valve 6 to control opening or closing of the fresh air duct. In addition, the fresh air valve 6 is made of a heat insulation and sound insulation material, so that the thermal insulation layer is continuous and soundproof and noise-proof. As shown in FIG. 6, the fresh air valve 6 is controlled by a motor 7. A second fan 9 is further provided in the fresh air duct, and the second fan 9 is located upwind of the fresh air valve. Both the motor 7 and a carbon dioxide sensor are connected to a control device to form a feedback control. The carbon dioxide sensor is configured to detect concentration of indoor carbon dioxide. When the concentration of the indoor carbon dioxide exceeds a preset threshold, the fresh air valve 6 is opened.

In addition, multiple filters are provided in Embodiment 2 to prevent ash from entering each air duct and to purify indoor air and air that enters from outdoor environment. A first primary-efficiency filter 1, a second primary-efficiency filter 5, a third primary-efficiency filter 19 and a fourth primary-efficiency filter 22 are respectively provided at the air outlet and air inlet of the return air duct, the air outlet and air inlet of the outdoor heat exchanger air duct, and the air inlet of the fresh air duct. A first high-efficiency filter 2 and a second high-efficiency filter 8 are respectively provided at the air outlet of the return air duct and the air outlet of the fresh air duct. The first high-efficiency filter 2 located at the outlet of the return air duct is located between the first primary-efficiency filter 1 and the indoor heat exchanger 3. The second high-efficiency filter 8 located at the outlet of the fresh air duct is located between the fresh air valve 6 and the second fan 9. Of course, types of these filters can be replaced or more filters can be provided at different positions of these air ducts according to requirements.

In addition to providing the wall-buried pipe 21 and the fresh air duct, in Embodiment 2, the throttle valve 10, the condensate water tank 11, the four-way valve 12, the compressor 13, and the outdoor heat exchanger 16 are all integrated in an integrated outdoor unit. The outdoor unit is provided with an air inlet and an air outlet, so that the outdoor heat exchanger air duct passes through the outdoor unit. During manufacturing, these components have been already integrated into the outdoor unit. Merely installing the outdoor unit can simplify an installation process of the fabricated air conditioner wall. In addition, the outdoor unit is located in a preset embedded groove located outside the precast wall, and an inner side of the embedded groove is provided with a thermal insulation material that is configured to insulate heat generated by the outdoor unit or prevent heat loss of the precast wall.

Each of an inner wall surface and an outer wall surface of the precast wall is provided with an access opening. A cover is provided on the access opening, and the access opening is configured to allow the primary-efficiency filter and the high-efficiency filter to pass through. The access opening is designed to facilitate later maintenance and filter replacement.

In Embodiment 2, an operation method of the fabricated air conditioner wall mainly includes a cooling mode and a heating mode. A main difference therebetween is that flowing directions of the refrigerant thereof are opposite, and various refrigerant circuits can be controlled and adjusted according to different temperatures of the precast wall.

Figure 3:
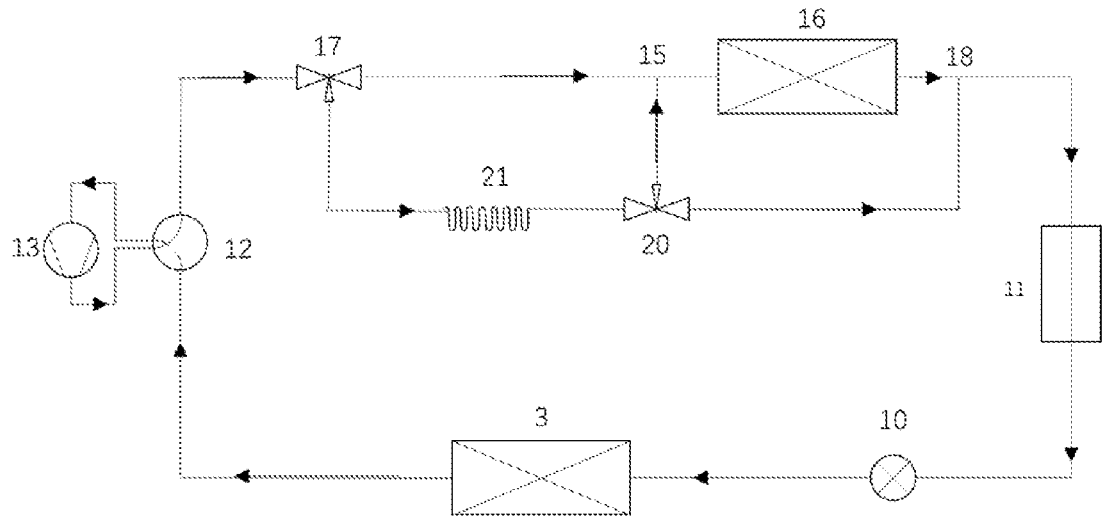
FIG. 3 is a schematic diagram of a refrigerant circuit in a cooling mode according to Embodiment 2.

1) As shown in FIG. 3, when the air conditioner is in the cooling mode, the first flow channel port of the four-way valve 12 is connected to the third flow channel port of the four-way valve 12, and the second flow channel port of the four-way valve 12 is connected to the fourth flow channel port of the four-way valve 12. The refrigerant enters the first three-way valve 17 after being compressed by the compressor 13. At this time, the second flow channel of the first three-way valve 17 is closed, and the refrigerant is cooled through the wall-buried pipe 21.

If the temperature of refrigerant is lower than the outdoor temperature after the refrigerant is cooled by the wall-buried pipe 21, the first flow channel port of the second three-way valve 20 is closed, and then the refrigerant directly returns to the compressor 13 after sequentially passing through the condensate water tank 11, the throttle valve 10, and the indoor heat exchanger 3.

If the temperature of the refrigerant is still higher than the outdoor temperature after the refrigerant is cooled by the wall-buried pipe 21, the second flow channel port of the second three-way valve 20 is closed, and then the refrigerant returns to the compressor 13 after sequentially passing through the outdoor heat exchanger 16, the condensate water tank 11, the throttle valve 10, and the indoor heat exchanger 3.

Figure 4:
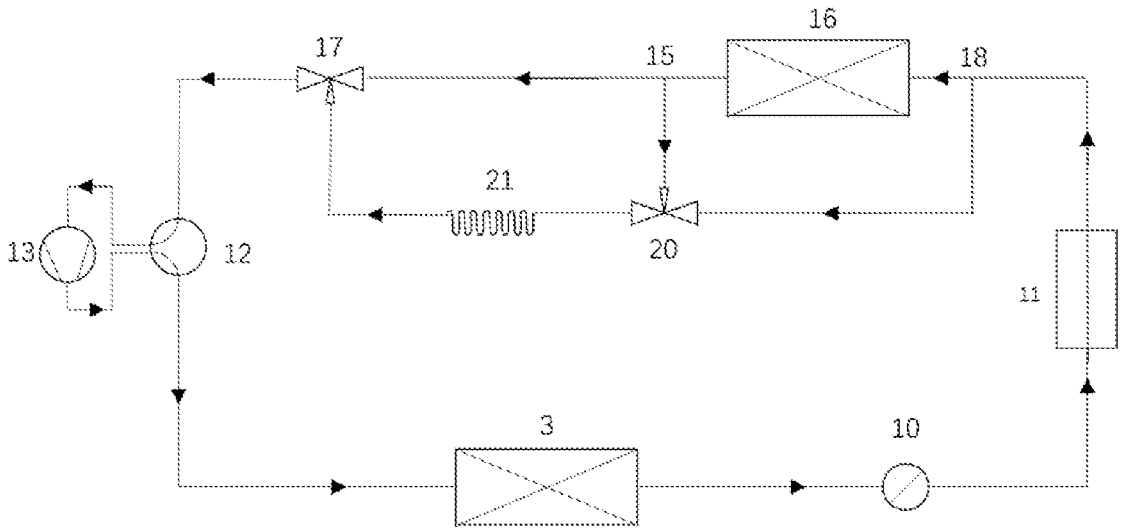
FIG. 4 is a schematic diagram of a refrigerant circuit in a heating mode according to Embodiment 2.

2) As shown in FIG. 4, when the heat pump system is in a heating mode, the first flow channel port of the four-way valve 12 is connected to the second flow channel port, and the third flow channel port of the four-way valve 12 is connected to the fourth flow channel port. The refrigerant sequentially enters the indoor heat exchanger 3, the throttle valve 10 and the condensate water tank 11 after being compressed by the compressor.

If the temperature of the precast wall is lower than the outdoor temperature, all three flow channel ports of the second three-way valve 20 are closed, and the refrigerant directly returns to the compressor 13 after passing through the outdoor heat exchanger 16.

If the temperature of the precast wall is higher than the outdoor temperature, the second flow channel port of the second three-way valve 20 and the second flow channel port of the first three-way valve 17 are closed, and the refrigerator returns to the compressor 13 after passing through the outdoor heat exchanger 16 and the wall-buried pipe 21.

In addition, the fabricated air conditioner wall in Embodiment 2 can also control the fresh air duct according to demands. When there is a need to introduce fresh air into the room, a motor 7 controls the fresh air valve 6 to open, so that the second fan 9 is activated, and thus fresh air is introduced from the outside. When there is no need to introduce the fresh air into the room, the motor 7 controls the fresh air valve 6 to close, so that the second fan 9 stops rotating, and thus an indoor circulation is performed.

The above embodiments are merely preferred embodiments of the present disclosure, and are not intended to limit the present disclosure. Those skilled in the art can make various changes and modifications without departing from the spirit and scope of the present disclosure. Therefore, any technical solution obtained by equivalent replacement or equivalent transformation falls within the protection scope of the present disclosure.

What is claimed is:

1. A fabricated air conditioner wall, comprising:

a precast wall provided with an inner thermal insulation layer (23) and an outer thermal insulation layer (24), wherein the inner thermal insulation layer (23) is located in the precast wall and on a side close to an inner wall surface of the precast wall and is configured to reduce heat exchange between the precast wall and an indoor environment, and the outer thermal insulation layer (24) is located in the precast wall and on a side close to an outer wall surface of the precast wall; and a heat pump system disposed in the precast wall and comprising a refrigerant circulation system and an air heat exchange duct, wherein the refrigerant circulation system comprises an indoor heat exchanger (3), a throttle valve (10), a condensate water tank (11), a four-way valve (12), a compressor (13), and an outdoor heat exchanger (16), wherein the compressor (13) comprises an inlet and an outlet respectively connected to a first flow channel port and a second flow channel port of the four-way valve (12), a third flow channel port of the four-way valve (12) is sequentially connected to the outdoor heat exchanger (16), the throttle valve (10) and the indoor heat exchanger (3), the indoor heat exchanger (3) is further connected to a fourth flow channel port of the four-way valve (12) to form a refrigerant circuit, the condensate water tank (11) is configured to receive condensate water discharged from the indoor heat exchanger (3) and is provided with a water outlet communicating with an outdoor environment, and a refrigerant pipeline connecting the outdoor heat exchanger (16) with the throttle valve (10) passes through the condensate water tank (11) to utilize cooling energy of condensate water in the condensate water tank;

wherein the air heat exchange duct comprises a return air duct and an outdoor heat exchanger air duct, wherein the indoor heat exchanger (3) is located in the return air duct, and the return air duct comprises an air inlet and an air outlet each located at the inner wall surface and communicating with the indoor environment; the outdoor heat exchanger (16) is located in the outdoor heat exchanger air duct, and the outdoor heat exchanger air duct comprises an air inlet and an air outlet each located at the outer wall surface and communicating with the outdoor environment; and the return air duct and the outdoor heat exchanger air duct are respectively provided with a first fan (4) and a third fan (14) therein for providing power;

wherein the refrigerant circulation system further comprises a wall-buried pipe (21), a first three-way valve (17), a first three-way pipe (15), a second three-way valve (20) and a second three-way pipe (18);

wherein the wall-buried pipe (21) is located in the precast wall and between the outer thermal insulation layer (24) and the outer wall surface;

wherein the first three-way valve (17) and the first three-way pipe (15) are provided in a refrigerant pipeline between the third flow channel port of the four-way valve (12) and the outdoor heat exchanger (16), wherein the third flow channel port of the four-way valve (12) is connected to a first flow channel port of the first three-way valve (17) first, a second flow channel port of the first three-way valve (17) is connected to a first flow channel port of the first three-way pipe (15), and then a second flow channel port of the first three-way pipe (15) is connected to an end of the outdoor heat exchanger (16);

wherein a third flow channel port of the first three-way valve (17) is connected to an end of the wall-buried pipe (21), another end of the wall-buried pipe (21) is connected to a third flow channel port of the second three-way valve (20) and a first flow channel port of the second three-way valve (20) is connected to a third flow channel port of the first three-way pipe (15);

wherein a first flow channel port of the second three-way pipe (18) is connected to another end of the outdoor heat exchanger (16), a second flow channel port of the second three-way pipe (18) is connected to a second flow channel port of the second three-way valve (20), a third flow channel port of the second three-way pipe (18) is connected to the throttle valve (10), and a refrigerant pipeline between the third flow channel port of the second three-way pipe (18) and the throttle valve (10) passes through the condensate water tank (11); and wherein the wall-buried pipe (21) is a heat exchange pipe to recycle heat in the precast wall, and the fabricated air conditioner wall is capable of automatically selecting a corresponding refrigerant circuit according to a temperature of the precast wall and a heat exchange effect of the wall-buried pipe (21).

2. The fabricated air conditioner wall according to claim 1, further comprising:

a fresh air duct comprising a main body located between the inner thermal insulation layer (23) and the outer thermal insulation layer (24), an air inlet located at the outer wall surface, a side surface or a top surface of a window and communicating with outdoor air, and an air outlet connected to the return air duct to serve as another air inlet of the return air duct, wherein the air outlet of the fresh air duct is provided with a fresh air valve (6) to control opening or closing of the fresh air duct, and the fresh air valve (6) is controlled by a motor (7) and is provided with a second fan (9) therein.

3. The fabricated air conditioner wall according to claim 2, wherein the condensate water in the condensate water tank (11) is discharged to the outer wall surface, and the fresh air valve (6) is made of a thermal insulation and sound insulation material.

4. The fabricated air conditioner wall according to claim 2, wherein primary-efficiency filters are respectively provided at the air outlet and the air inlet of the return air duct, the air outlet and the air inlet of the outdoor heat exchanger air duct, and the air inlet of the fresh air duct, and high-efficiency filters are respectively provided at the air outlet of the return air duct and the air outlet of the fresh air duct.

5. The fabricated air conditioner wall according to claim 1, wherein the throttle valve (10), the condensate water tank (11), the four-way valve (12), the compressor (13) and the outdoor heat exchanger (16) are disposed in an integrated outdoor unit, and the outdoor unit is provided with an air inlet and an air outlet in such a manner that the outdoor heat exchanger air duct passes through the outdoor unit.

6. The fabricated air conditioner wall according to claim 5, wherein the outdoor unit is located in a preset embedded groove located outside the precast wall, and a wall surface of the preset embedded groove is provided with a thermal insulation material thereon.

7. The fabricated air conditioner wall according to claim 1, wherein each of the inner wall surface and the outer wall surface of the precast wall is provided with an access opening, a cover is provided on the access opening, and the access opening is configured to allow a primary-efficiency filter and a high-efficiency filter to pass through.

8. The fabricated air conditioner wall according to claim 1, wherein the return air duct is located between the inner thermal insulation layer (23) and the inner wall surface.

9. An operation method of the fabricated air conditioner wall according to claim 1, comprising:

1) When the heat pump system is in a cooling mode, a refrigerant circuit comprising:

the refrigerant being compressed by the compressor (13), and a refrigerant circuit after the compression of the compressor (13) being cooled by the wall-buried pipe (21);

if a temperature of the refrigerant is lower than an outdoor temperature after the refrigerant is cooled by the wall-buried pipe (21), the refrigerant circuit bypassing the outdoor heat exchanger (16);

if the temperature of the refrigerant is higher than the outdoor temperature after the refrigerant is cooled by the wall-buried pipe (21), the refrigerant circuit being re-cooled by passing through the outdoor heat exchanger (16); and after being cooled, the refrigerant being further cooled by passing through the condensate water tank, then entering the indoor heat exchanger (3) through the throttle valve (10) for expanding and absorbing heat, and finally returning to the compressor (13); and 2) when the heat pump system is in a heating mode, the refrigerant circuit comprising:

after being compressed by the compressor (13), the refrigerant entering the indoor heat exchanger (3) for releasing heat and then passing through the throttle valve (10) for expanding and cooling;

if a temperature of the precast wall is lower than the outdoor temperature, the refrigerant after passing through the throttle valve (10) absorbing heat only through the outdoor heat exchanger (16);

if the temperature of the precast wall is higher than the outdoor temperature, the refrigerant after passing through the throttle valve (10) absorbing heat again through the outdoor heat exchanger (16) and the wall-buried pipe (21); and the refrigerant returning to the compressor (13) after absorbing heat.

* * * * *